United States Patent [19]

Epps

[11] 4,400,963

[45] Aug. 30, 1983

[54] ROLLER ENTRY GUIDE FOR ANGLES

[75] Inventor: Fred A. Epps, Manitoba, Canada

[73] Assignee: AMCA International Limited, Montreal, Canada

[21] Appl. No.: 329,066

[22] Filed: Dec. 9, 1981

[51] Int. Cl.[3] ..... B21B 39/16

[52] U.S. Cl. ..... 72/250; 226/189; 226/190; 72/428

[58] Field of Search ..... 72/133, 250, 428, 170, 72/171, 173, 178, 179; 226/189, 190

[56] References Cited

U.S. PATENT DOCUMENTS

| | | | |
|---|---|---|---|
| 2,599,847 | 6/1952 | Kritscher | 72/428 |
| 3,333,451 | 8/1967 | Inlow | 72/250 |
| 3,426,568 | 2/1969 | Cofer | 72/250 |
| 3,561,240 | 2/1971 | Schey | 72/250 |
| 3,566,656 | 3/1971 | Matsumuro | 72/250 |
| 3,620,063 | 11/1971 | Irsinczky | 72/250 |
| 3,740,989 | 6/1973 | Petros | 72/250 |
| 3,751,959 | 8/1973 | Ory | 72/250 |
| 3,798,952 | 3/1974 | Easter | 72/250 |
| 3,818,744 | 6/1974 | Sayer | 72/250 |
| 3,935,722 | 2/1976 | Bock | 72/250 |
| 4,073,173 | 2/1978 | Marshall et al. | 72/250 |
| 4,086,801 | 5/1978 | Nakajima et al. | 72/250 |
| 4,316,376 | 2/1982 | Masui et al. | 72/250 |

FOREIGN PATENT DOCUMENTS

| | | | |
|---|---|---|---|
| 643166 | 6/1962 | Canada . | |
| 715897 | 9/1954 | United Kingdom | 72/171 |

*Primary Examiner*—Francis S. Husar
*Assistant Examiner*—Jonathan L. Scherer
*Attorney, Agent, or Firm*—Larson and Taylor

[57] ABSTRACT

A roller entry guide assembly for angle shapes is disclosed. The assembly is used in steel rolling mills and overcomes the problems of distortion due to the friction of fixed guides in high speed mills. The assembly comprises a support frame, two freely rotating bottom rollers rigidly mounted in a horizontal plane in the support frame, each of the bottom rollers having sides contoured to fit an angle configuration with the largest diameter at the center, and a freely rotating top roller positioned above and between the two bottom rollers, and parallel thereto, the top roller being adjustably mounted from the support frame to vary the height above the bottom rollers, the top roller having sides contoured to fit an angle configuration with the smallest diameter at the center adapted to guide and position an angle shape between the top and bottom rollers in conjunction with the bottom rollers.

7 Claims, 3 Drawing Figures

ROLLER ENTRY GUIDE FOR ANGLES

This invention relates to steel rolling mills. More particularly the invention relates to a roller entry guide assembly for rolling of angle shapes.

Rolled steel angle shapes are made in a series of passes between rollers, wherein the angle is formed a little more in each pass, and different shapes of rollers are provided up to the final pass. For the final few passes, the angle shape is formed, however, because of the length of the rolled angle it is necessary to guide it to ensure the angle is correctly aligned to pass between the finishing rolls. If the angle is not correctly positioned before being rolled then distortion or the like occurs which results in an unsatisfactory product.

In the past when rolling mills operated at slower speeds, and maximum angle lengths were not greater than 180 ft., cast steel entry guides were positioned at the entry to the finishing rolls. A bottom guide was positioned to support the underside of the rolled bar or angle and a pair of steel side guards were provided on either side of the bar or angle to avoid deviation from side to side which could jeopardize the resulting product.

This type of entry guide was used for many years. The guide was mounted in a box which was in turn mounted to the finishing roll stand as close as possible to the bite on the finishing rolls. However, with new high speed rolling mills which produce angle shapes as long as 5,000 ft. at speeds up to 3,000 ft. per minute, the fixed cast steel guides become very hot due to the friction of the angle passing over the guide, and it has been found that it is not possible to cool and lubricate the guide adequately to prevent scale and the like from being picked up on the guides. This in turn deforms the guiding surface, and the bar is disoriented before entering the finishing rolls which deforms the product. Every time such an occasion occurs, it is necessary to change the guide which usually results in a down time of from 20–30 minutes and these changes may be required as often as every two or three hours.

To overcome the problem of distortion of the fixed guides, roller guides have been utilized. In the case of an angle, the roller guides have horizontal axes and the angle sits on the bottom roller guide which has a V-shaped configuration to exactly position the angle. In a first attempt to solve the problem, the roller guide assembly had only two rollers, a top roller and a bottom roller. Such a configuration did not perform satisfactorily under certain conditions, because it did not locate the elevation of the angle shape leaving the roller guide, and sometimes deformation was caused because the alignment from the guide rollers to the finishing rolls was incorrect. In some cases this problem could be solved by changing the guide rollers to ones of different diameter, however, this required maintenance work and down time of the rolling mill.

It is the purpose of the present invention to provide a roller entry guide assembly for rolling different sizes of angle shapes without having to change the rollers and having to do the minimum of adjustment for different angle thicknesses. Furthermore, the present invention provides an assembly that reduces frictional heat on an angle as it passes therethrough. It is a further purpose to provide a roller entry guide assembly which directs the angle issuing from the roller guide directly into the bite of the finishing rolls, for completing the final rolling. It is also a purpose of the present invention to provide a roller entry guide assembly suitable for high speed rolling of angles in long lengths which overcomes the problems of existing types of guides.

The present invention provides a roller entry guide assembly for rolling of angle shapes comprising, a support frame, two freely rotating bottom rollers rigidly mounted in a horizontal plane in the support frame, each of the bottom rollers having sides contoured to fit an angle configuration with the largest diameter at the center, a freely rotating top roller positioned above and between the two bottom rollers and parallel thereto, the top roller being adjustably mounted from the support frame to vary the height above the bottom rollers, the top roller having sides contoured to fit an angle configuration with the smallest diameter at the center, adapted to guide and position an angle shape between the top and bottom rollers in conjunction with the bottom rollers.

In other embodiments the present invention provides for the top roller to be mounted on a bracket pivoted to the support frame at a pivot location downstream of the direction of movement of the angle shapes through the top and bottom rollers. In a further embodiment the top roller is adjustable for height by means of two threaded bolts and nuts. Spring means may be provided to hold the top roller at a preset height above the bottom rollers. Water spray is preferably supplied for cooling the top and bottom rollers, and in one embodiment the top and bottom rollers are supported at each end by tapered roller bearings and include a lubrication and cooling system for each of the bearings. A guide deflector plate may be mounted on the bracket pivoted to the support frame, to assist in guiding an angle shape between the top and bottom rollers.

In drawings which illustrate the embodiments of the invention,

Figure 2:
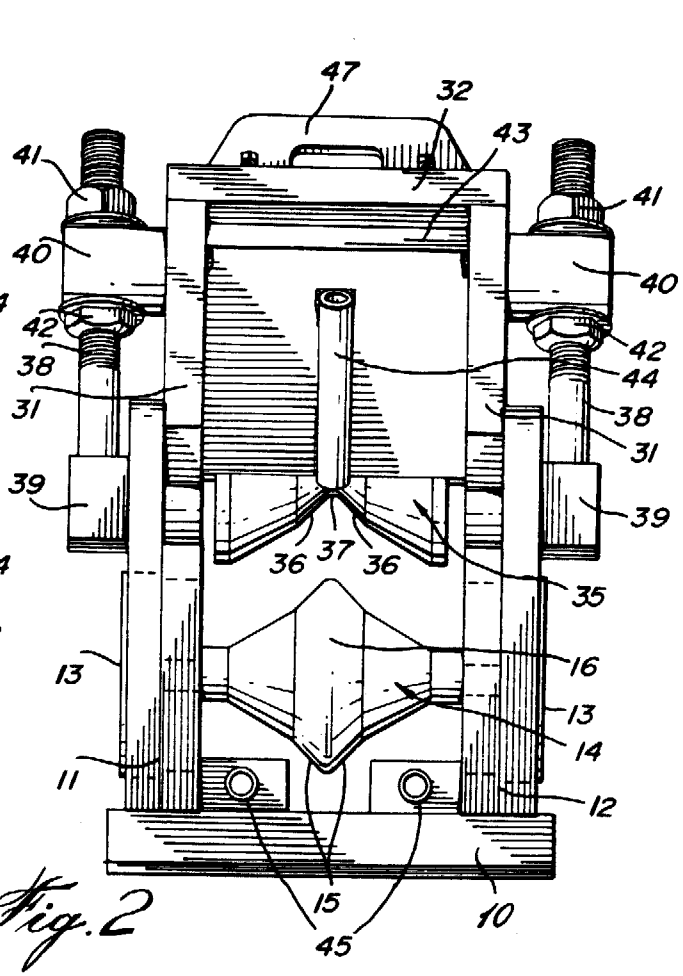
FIG. 2 is a front view of the roller guide assembly shown in FIG. 1.
Figure 1:
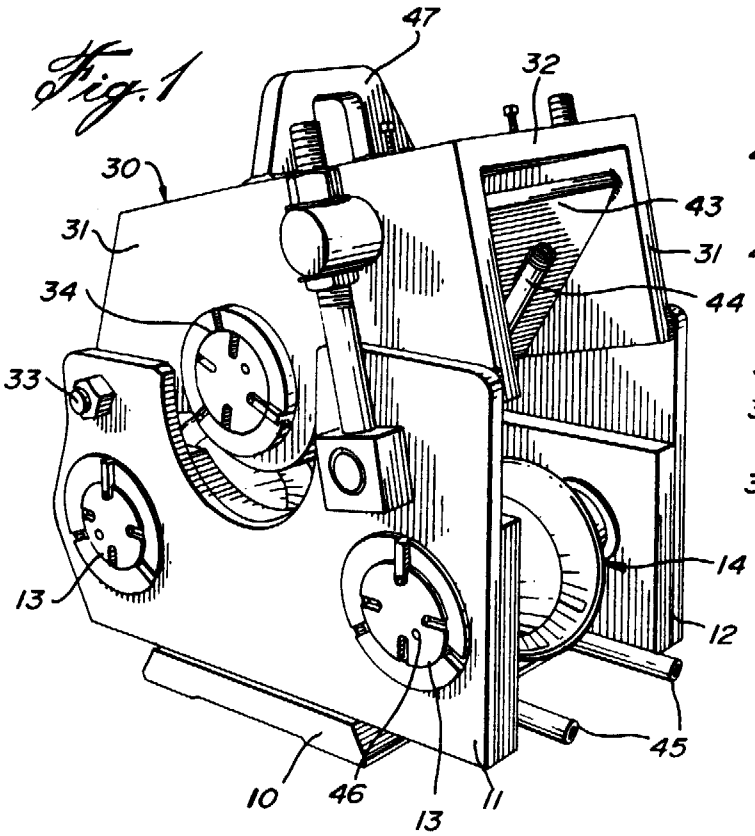
FIG. 1 is an isometric side view showing one embodiment of the roller guide assembly according to the present invention.

Referring now to the drawings, a base plate 10 has two side plates 11 and 12 welded thereto to form an open channel-shaped configuration. The side plates 11 and 12 each have two holes 13 horizontally in line and lined up with holes 13 on the other plate, and two bottom rollers 14 are supported between the side plates 11 and 12. Each of the bottom rollers 14 has sides 15 contoured to fit an angle configuration, with the largest diameter at the center forming a circular radiused ridge 16, slightly proud of the surface of the roller to support an angle passing therethrough.

The sides of the rollers are contoured to fit the profile of an angle shape entering the finishing rolls of a rolling mill. The final shape of the rolled angle is not achieved until the last pass.

Figure 3:
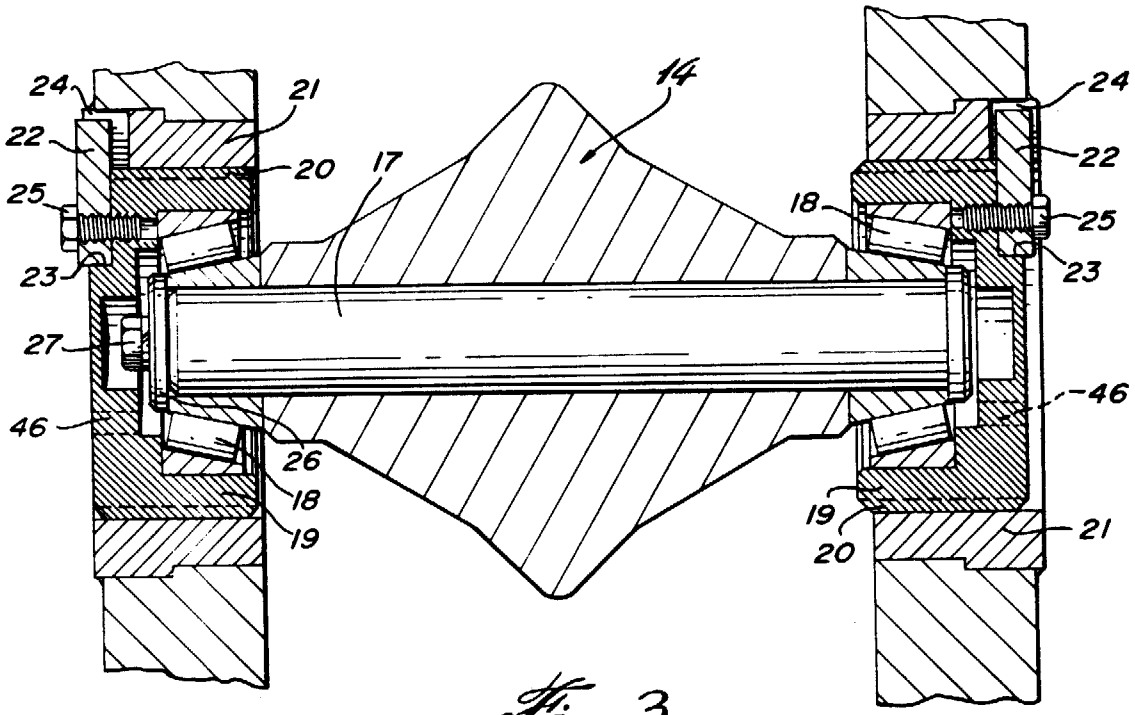
FIG. 3 is a partial cross sectional elevational view through one of the roller axes showing the bearing configuration.

The support of each roller bearing is illustrated in FIG. 3 wherein a shaft 17 is supported at each end by a sealed tapered roller bearing 18. Each bearing 18 is held by a hub nut 19 which has a threaded external diameter 20 fitting into an internal thread of a replaceable bushing 21 which is welded into the main side plates 11 and 12. Rotation of the hub nut 19 provides lateral adjustment and positioning of the roller 14. A key 22 fits into one of four slots 23 in the hub nut 19 and mates with one of three slots 24 in the bushing 21 to prevent rotation of the hub nut in the bushing. A set screw 25 holds the key 22 in place. The hub nut 19 and bearing 18 may be replaced when necessary due to wear or damage. The roller is a slip fit on shaft 17, and a keeper plate 26 is provided at one end with a set screw 27 to hold the roller and bearings 18 on the shaft 17.

A top bracket 30 comprises two side plates 31 and a top plate 32 welded together and has pivot pins 33 above one set of holes 13 in the side plates 11 and 12, thus allowing the top bracket 30 to pivot about the pivot pins 33. The location of the pivot pins 33 becomes the downstream or exit side of the assembly, thus the angles leave the assembly at this downstream or exit side. Holes 34 opposite each other in the two side plates 31 of the top bracket 30 support a top roller 35 which has a different configuration to the lower rollers 14 in that it has sides 36 contoured to fit an angle configuration with a groove 37 at the center being the smallest diameter. Thus, an angle passing between the two bottom rollers 14 and the top roller 35 has its corner at the center of the assembly.

In the embodiment shown, the shape of the top roller 35 matches the bottom rollers 14 and are contoured to fit the profile of an angle shape entering the finishing rolls of the rolling mill.

In the case of unequal leg angles, the profiles are tipped towards the short leg. In one configuration the apex is tipped at an angle to the vertical plane so the sloped sides are at different angles. This tipping of the apex equalizes the rolling load between the separating and the lateral forces.

The top roller 35 is supported on a shaft 17 and two tapered roller bearings 18 as illustrated in FIG. 3. The top bracket 30 pivots about the pivot pins 33, thus allowing the top roller 35 to move away from the two bottom rollers 14. Two threaded trunnion bolts 38, one on each side, are attached to the side plates 11 and 12 by means of trunnion blocks 39. The bolts 38 extend upwards and pass through a hole in a cylindrical shaft 40 which is attached to the side plates 31 of the top bracket 30. A nut 41 above the cylindrical shaft 40 controls the pivoting movement of the bracket 30 and a further lock nut 42 beneath the cylindrical shaft 40 retains the bracket 30 in that particular position. Movement of this bracket 30 upwards and downwards and hence movement of the top roller 35 relative to the bottom rollers 14 may be made by adjustment of these two nuts 41 and 42.

In another embodiment the lock nuts 42 on the bolts 38 may be replaced by a spring which is sufficiently strong to hold the top roller in its desired location. The spring avoids the necessity of having to adjust the lock nut 42 when changing the height of the top roller 35 relative to the bottom rollers 14.

At the front of top bracket 30 a guide plate 43 is positioned such that it can act as a deflector to ensure that when an angle is fed into the roller entry guide assembly, it is deflected down between the top roller 35 and the bottom rollers 14.

Cooling for the rollers is provided by a water spray. A top water pipe 44 provides water for spraying between the rolls, and bottom water pipes 45 on each side of the bottom rollers 14 spray water onto the sides of the rollers to ensure cooling at all times.

The rollers are cooled continuously because they are in contact with hot steel at approximately 1000° C. Provision is made to drain off the water after spraying.

As illustrated in FIG. 3 lubrication holes 46 are provided at each bearing for lubrication.

The lubrication system may be an oil or grease, automatic, semi automatic or manual system. In one embodiment an air/oil lubrication system is used wherein compressed air is continually passed through the bearings and a measured amount of oil on a preset time cycle is injected into the compressed air line and conveyed to each bearing. The air pressurizes the bearing keeping out water and dirt, and evacuates through the natural openings of the bearing assembly.

In operation, the thickness of the angles to be rolled determines the height of the top roller 35 above the bottom rollers 14. This thickness can be set by the nuts 41,42 on the threaded bolts 38. This is the only adjustment necessary for angles whereas in previous entry guides it has been necessary to have side guides. No side guides are needed here and no adjustments need be made to suit different sizes of angles provided thickness of the leg is similar. Speed of the angle shapes passing through the roller entry guide assembly has been up to 3,000 ft. per minute, and lengths of angle shapes have been as long as 5,000 ft. By using water cooling and lubrication of the bearings, there has been no excessive heating or distortion of the angles passing through this roller entry guide assembly. A lifting lug 47 is provided on top of the assembly so it may be removed for regular maintenance at longer time intervals than previously used types of entry guides.

Various changes to this roller entry guide assembly may be made without departing from the scope of the present invention which is limited only by the following claims.

The embodiment of the invention in which an exclusive property or privilege is claimed are defined as follows:

1. Roller entry guide assembly for rolling straight angle shapes, comprising a support frame, two bottom rollers rigidly mounted in a horizontal plane in the support frame, each of the bottom rollers having sides contoured to fit an angle configuration with the largest diameter at the center, means for mounting the two bottom rollers for free rotation, a top roller positioned above and between the two bottom rollers, and parallel thereto, the top roller being adjustably mounted from the support frame to vary the height above the bottom rollers, the top roller having sides contoured to fit an angle configuration with the smallest diameter at the center adapted to guide and position an angle shape between the top and bottom rollers in conjunction with the bottom rollers, and means for mounting the top roller for free rotation so that a straight angle shape is freely advanced between the top roller and both bottom rollers without deforming the straight angle shape.

2. The roller guide assembly according to claim 1 wherein the top roller is mounted on a bracket, pivoted to the support frame at a pivot location downstream of the direction of movement of the angle shapes through the top and bottom rollers.

3. The roller guide assembly according to claim 2 wherein the top roller is adjustable for height by means of two threaded bolts and nuts located on either lateral side of the rollers.

4. The roller guide assembly according to claim 3 wherein spring means are provided to hold the top roller at a preset height above the bottom rollers.

5. The roller guide assembly according to claim 1 including a water spray for cooling the top and bottom rollers.

6. The roller guide assembly according to claim 1 wherein the top and bottom rollers are supported at each end by tapered roller bearings and including a means for lubricating each of the bearings.

7. The roller guide assembly according to claim 2 including a guide deflector plate mounted on the bracket, pivoted to the support frame, to assist in guiding an angle shape between the top and bottom rollers.

* * * * *